United States Patent [19]

Berthagen

[11] 3,981,111

[45] Sept. 21, 1976

[54] INSULATING UNIT

[76] Inventor: Nils Ture Lennart Berthagen, Manadsvagen 74, S-175 42 Jarfalla, Sweden

[22] Filed: Mar. 3, 1975

[21] Appl. No.: 554,833

[30] Foreign Application Priority Data

Mar. 1, 1974 Sweden ..... 7402787

[52] U.S. Cl. ..... 52/171; 52/203; 52/304; 52/393; 52/616

[51] Int. Cl.[2] ..... E06B 3/24; E06B 7/12

[58] Field of Search ..... 52/171, 172, 203, 204, 52/208, 616, 304, 396, 393

[56] References Cited

UNITED STATES PATENTS

| | | | |
|---|---|---|---|
| 2,111,343 | 3/1938 | Walz | 52/203 |
| 2,308,918 | 1/1943 | Hertel et al. | 52/203 |
| 2,708,774 | 5/1955 | Seelen | 52/616 |
| 3,192,575 | 7/1965 | Rosenau et al. | 52/171 |
| 3,399,294 | 8/1968 | Thieben | 52/171 |
| 3,837,126 | 9/1974 | Voiturier et al. | 52/171 |

FOREIGN PATENTS OR APPLICATIONS

| | | | |
|---|---|---|---|
| 195,086 | 1/1958 | Austria | 52/203 |
| 331,559 | 1/1971 | Sweden | 52/203 |

*Primary Examiner*—J. Karl Bell
*Attorney, Agent, or Firm*—Sughrue, Rothwell, Mion, Zinn and Macpeak

[57] ABSTRACT

There is provided an insulating unit, such as a double-glazed sealed window unit, comprising at least two spaced-apart transparent plates. The plates are sealingly joined together around their peripheral edges by sealing means, thereby to form a sealed chamber in which there is enclosed a medium such as gas, air or liquid. Means are provided to permit a pivoting movement of at least one of the transparent plates towards and away from an opposing plate, thereby to increase or decrease the volume of the enclosed medium in response to changes in the temperature of the transparent plates.

8 Claims, 6 Drawing Figures

INSULATING UNIT

Figure 1:
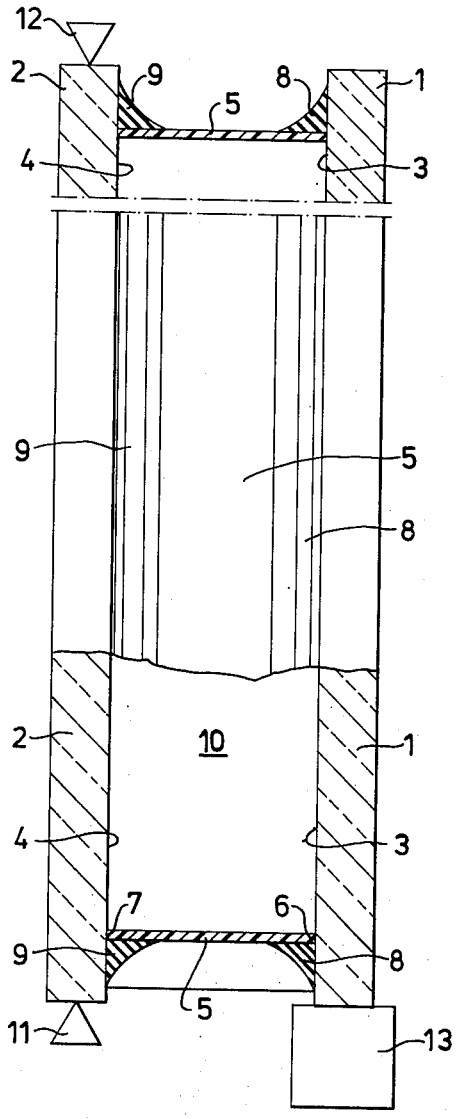

The present invention relates to an insulating unit of the kind comprising at least two mutually opposing transparent plates which are joined together along their side edge portions by means of a substantially gas-tight and liquid-tight sealing means, said sealing means being arranged, together with said transparent plates, to define a closed chamber and to permit movement between the plates.

Insulating units of this kind, which may have the form of double-glazed seal window units for example, have become more and more popular over the past years and have a number of advantages to offer. For example, in the case of a sealed unit it is only necessary to clean the two external sides of the unit, instead of both sides of the two transparent plates in the case of an unsealed unit. Furthermore, with the sealed insulating unit, a higher degree of heat economy is obtained.

One disadvantage with the sealed insulating unit, however, is that the substance enclosed within the unit is subjected to thermal expansion and contraction, said substance normally comprising dry air, although a gas or a liquid is also sometimes used. This problem becomes greater in countries where there is a great deal of radiation and high variations in temperature.

The enclosed substance, hereinafter referred to as the enclosed volume, is also affected by the height of the building in which the insulating unit is installed above sea level. Thus, when manufacturing insulating units, such as double-glazed, sealed window units for example, the pressure of the enclosed gas, air or liquid must be adapted to the height of the installation above the sea and an account must be taken of the average temperature prevailing in the vicinity of said installation.

Despite these precautions there is a radical difference between the change in volume of the enclosed medium; even between, for example, windows installed in one and the same building, due to the particular situation of the building, radiation, reflexion, shaded areas etc.

A change in said volume of up to 50% can be generally expected between the darker periods of the year, where there is no or little sun, and the sunny periods of the year. If the pressure between the transparent plates, which may be made of glass or a plastics material, corresponds to normal atmospheric pressure at, for example, a temperature of 20°C, the two plates will bend outwardly at temperatures above 20°C.

As soon as the two transparent plates, which are conceived normally to be completely flat, begin to bend in one direction or the other, there is obtained a distorted image through said plates. A more serious disadvantage resides in the fact that repeated movement of the two transparent plates is liable to cause the metal sealing strip, which joins the two plates, or the joint between said metal strips and the plates, to break, thereby necessitating replacement of said plates, since it is impossible to remove any dust which may penetrate into the sealed unit from the inner surface thereof, and because condensates are liable to form. In extreme cases, the plates are liable to shatter as a result of the change in volume of the medium enclosed in the unit. Attempts have been made to solve this problem by arranging the plates so that they are movable relative to each other, at least one plate being arranged for movement in a plane parallel with the other plate.

Insulating units of the aforementioned kind in which the two plates arer arranged for parallel movement relative to one another are known, for example, from the U.S. Pat. No. 2,111,343. In order to arrange for parallel movement of the plates, it is necessary that the bottom edge of one plate, as seen in use, is slidably mounted. Owing to the relatively heavy weight of the plate, however, such mounting is extremely complicated and is so expensive that it cannot be realized in practice.

An object of the present invention is therefore to provide an insulating unit of the aforementioned kind having at least one movable plate which, irrespective of its own weight, can be readily arranged for relative movement to decrease or to increase the volume of enclosed air, gas or liquid.

Accordingly, this invention consists in an insulating unit of the kind comprising at least two mutually opposing transparent plates joined together along their side edge portions by means of a substantially gas-tight and liquid-tight sealing means, said sealing means being arranged, together with said transparent plates, to define a closed chamber and to permit movement between the plates, wherein at least one plate is arranged to effect a pivoting movement around an axis at its lower edge relative to the other plate, thereby to compensate for changes in pressure in said enclosed chamber.

Figure 2:
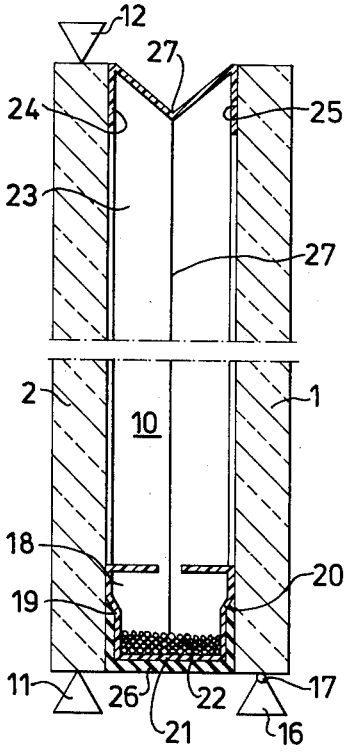
Figure 3:
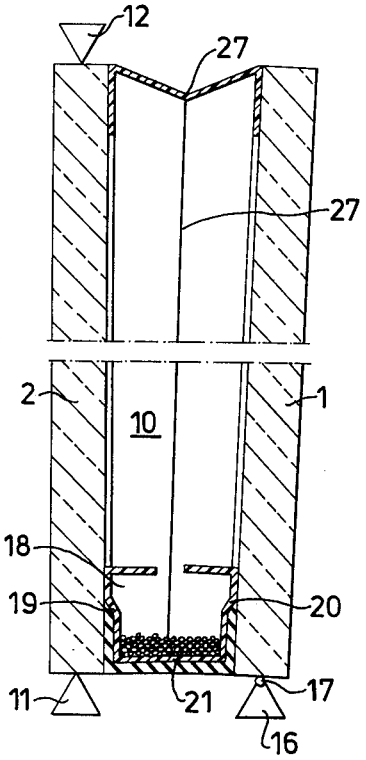
Figure 4:
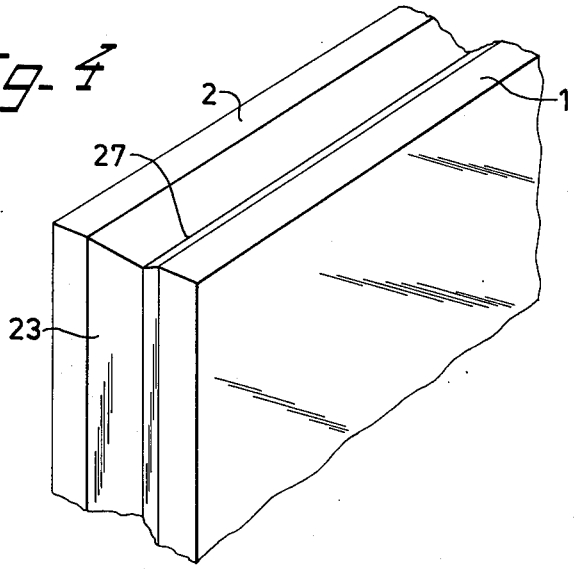
Figure 5:
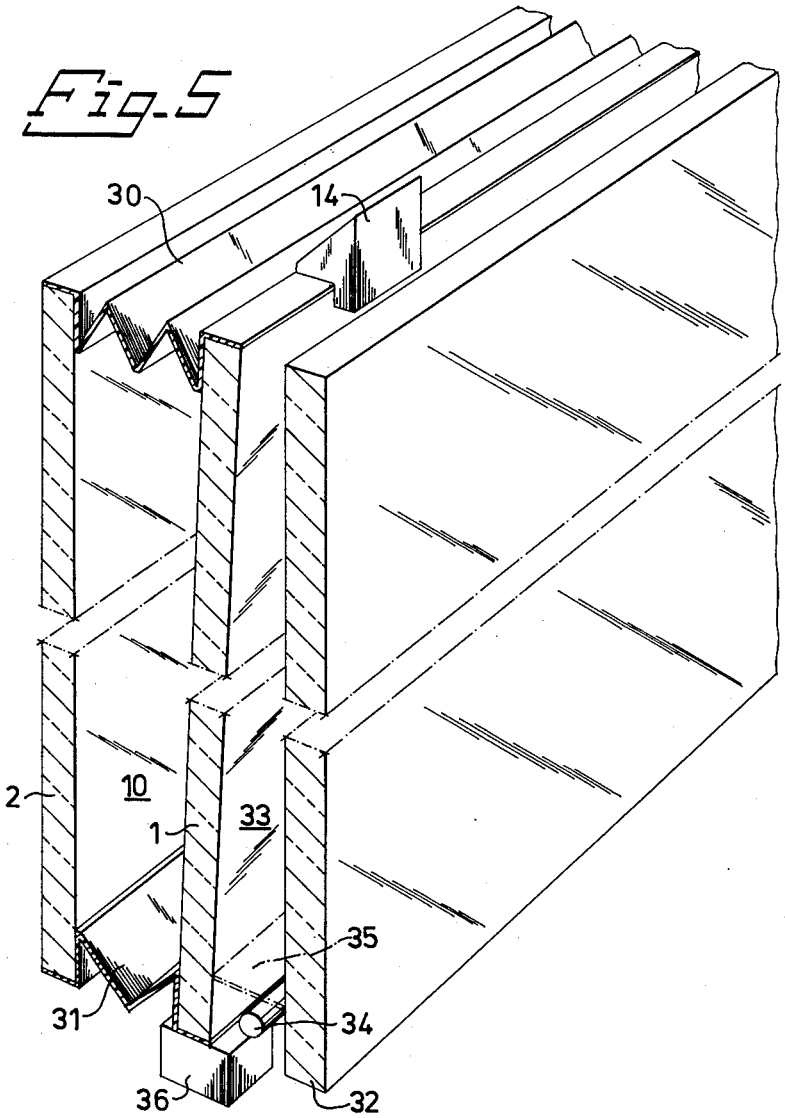
Figure 6:
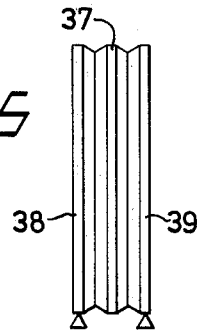

So that the invention will be more readily understood and further features thereof made apparent, exemplary embodiments of the invention will now be described with reference to the accompanying drawings, in which FIG. 1 shows one embodiment of an insulating unit, FIG. 2 shows an embodiment of the insulating unit with the two plates in a normal position relative to each other, FIG. 3 shows the insulating unit of FIG. 2 subsequent to the medium enclosed therein being heated, FIG. 4 is a perspective view of a corner of the insulating unit shown in FIGS. 2 and 3, FIG. 5 is a sectional view through an embodiment of the insulating unit having a third plate, and FIG. 6 is an extremely simple view of further embodiment of said insulating unit.

In FIG. 1 there is shown an insulating unit, such as a double-glazed sealed window unit, seen from one vertical side edge thereof and with the upper edge portions cut away. The insulating unit comprises two panes or plates of glass 1 and 2 which, with the illustrated embodiment, are assumed to be flat and rectangular in shape, although other shapes and forms are conceivable. Further panes or glass may be arranged between the two illustrated panes if so desired. The panes or plates of the insulating unit may be made of a transparent material other than glass, such as a rigid plastics material, but for the sake of simplicity the following description will be made with reference to glass panes.

The two glass panes 1 and 2 are shown in FIG. 1 to occupy a normal position relative to each other, which with the illustrated embodiment means that the glass panes lie in mutually parallel planes. The mutually opposing surfaces 3, 4 of the panes 1 and 2 are joined together by means of a sealing strip 5 which extends peripherally around all four side edges of respective glass panes. The sealing strip 5 forms a gas-tight wall, the side edges 6 and 7 of which are joined to respective panes 1, 2 by means of, for example, a flexible sealing agent which is arranged in the form of strings 8, 9. The sealing agent may, for example, comprise a vulcanized rubber compound. It is also possible, however, to join the sealing strip 5 to the glass panes 1 and 2 by means of any other appropriate type of bonding agent.

The sealing strip 5 may comprise a flexible or stretchable material, such as a rubber or plastics material, or, as will be evident hereinafter, may be made of metal. Thus, the sealing strip 5 joined in an air-tight manner to the glass panes 1 and 2 forms, together with the panes 1, 2 a closed chamber 10, it being assumed that the glass panes are totally impervious to gas, air or liquid. The chamber 10 is filled with a medium, which with the illustrated embodiments is assumed to be air and preferably dry air. When manufacturing the insulating unit, the pressure of the air in the chamber 10 is preferably adjusted to a normal average temperature and a normal air pressure within the vicinity in which the insulating unit is to be used and when assembled the distance between the two glass panes will be that indicated in FIG. 1.

With the illustrated embodiments, the glass pane 2 is assumed to be fixedly mounted on diagrammatically illustrated support means 11 and 12 forming part of a frame structure, such as a window frame (not shown). The glass pane 1 is arranged for movement relative to the glass pane 2, said movement being indicated by means of the fact that the bottom edge of the pane 1 rests on a longitudinally extending strip 13. The strip 13 may extend continuously along the whole of the bottom edge of the glass pane 1 or may have the form of a number of separate support elements located at the end portions of the said edge and is preferably manufactured from a plastics or rubber material having a degree of hardness such that the entire weight of the pane 1 can be taken up and said pane held in a substantially fixed vertical position. The strip 13 may be securely connected to the aforementioned frame structure (not shown) or may be held stationary in some other suitable manner by means of securing elements (not shown). The bottom edge of the plate 1 may be fixedly connected to the strip by means of a bonding agent for example, or the upper surface of the strip 13 may be provided with a groove in which the bottom edge portion of the glass pane 1 can be received. The lower edge portion of said pane cannot, therefore, move to any appreciable extent towards or away from the glass pane 2, although, on the other hand, the glass pane 1 is able to pivot in its entirety around the bottom edge of said pane owing to the flexibility of the strip 13, said bottom edge forming a pivot axis.

The strip 13, together with additional support means (not shown) permit pivoting of the movable glass pane 1 towards and away from the fixed glass pane 2. If, for example, the medium in the chamber 10 is cooled the pressure of the medium will decrease to a corresponding degree and the flexible sealing strip 5 will permit movement of the glass pane 1 towards the glass pane 2 via a pivoting movement around the bottom edge of the pane 1. The pressure in the chamber 10 is thus automatically regulated so that the glass panes are not subjected to bending forces which are liable to splinter or to deform said panes.

FIGS. 2 – 4 show a modified embodiment of the invention.

As with the previously described embodiment, the fixed glass pane 2, which is preferably intended to face toward the outside of a building, is fixedly mounted on support means 11, 12. The bottom edge of the movable glass pane 1 is supported on a support means 16 and is pivotable around a horizontal axis 17.

The two glass panes 1 and 2 are joined together around their respective edge portions by means of a sealing element, to form a closed chamber 10, similar to the embodiment first described. With the embodiment shown in FIGS. 2 – 4, the sealing element comprises a bottom strip 18 which extends along the bottom edge of the insulating unit. The strip 18 has a substantially U-shaped cross-section with two vertical legs 19, 20 and a horizontal, planar bottom 21. With the illustrated embodiment a moisture absorbing agent 22 is arranged in the interior of the strip.

The remaining three sides of the insulating unit are surrounded by a bellow-like strip 23 having two planar side flanges 24, 25. Similar to the strip 18, the strip 23 is air-tight and is made, for example, of stainless steel, plastics material or a similar resilient material. The end portions of the two strips are joined together to form a sealed frame structure. The flanges 24 and 25 and the legs 19 and 20 are, for example, fixedly attached to the glass panes. A flexible sealing agent 26 is arranged against the strip 18 and adjacent surface portions of the two glass panes.

As will be seen from FIG. 3, an increase in the pressure acting on the volume of medium enclosed in the chamber 10 will cause the pivotable glass pane 1 to pivot clockwise about the pivot axis 17 and therewith to provide a balancing of the pressure to prevent deforming forces acting on the glass panes. When the medium in the chamber 10 is cooled, the movable glass pane 1 will rotate anti-clockwise as seen in FIG. 3 thereby to reduce the volume of the chamber 10. This pivoting of the glass pane 1 is permitted partly due to the fact that the planar bottom 21 of the strip 18 is bent along the longitudinal axis and partly due to the fact that a fold 27 on said strip permits stretching (straightening) or compression of the strip 23 respectively.

In FIG. 5 there is shown an embodiment of the invention which is provided with a third plate 32 of transparent material, such as glass or transparent plastics material. As with the embodiments previously described, the two panes relatively movable with respect to each other are identified by the reference numerals 1 and 2 respectively. Similar to the aforementioned third pane 32, the two panes 1 and 2 may also be made of glass or a transparent plastics material. The two panes 1 and 2 are joined together in a gas-tight and preferably also a liquid-tight manner by means of a flexible strip 30, 31 extending peripherally around the panes. As with the embodiment described with reference to FIGS. 2 – 4 the two panes 1 and 2 are arranged to effect a pivoting movement relative to one another in response to changes in pressure of the volume of medium 10 enclosed between the panes 1, 2 and the strips 30, 31 and the end portions of the pane 1 are assumed to rest on rubber blocks or the like, of which one block 36 is shown. The pane or transparent plate 1 is turned to face the inside of the building in which the unit is to be installed. The third pane 32 is spaced from the pane 1 and there is formed between said panes a space 33 which is open at least at the top and the bottom thereof. As shown in FIG. 5, guide means 14 are conveniently provided to guide the pivoting movement of the pivotable glass pane 1. With the illustrated embodiment, the guide means 14 comprise resilient elements, such as rubber bodies, which are stationarily arranged and which have a degree of resiliency sufficient to permit the required movement of the pane 1.

If it is assumed that the pane 1 is heated by the sun to a temperature higher than the temperature of the pane 32 facing the space 33, a stream of air will rise up through said space 33 therewith to cool the pane 1; that is to say heat is transported from the enclosed volume 10 causing a reduction in the relative movement between the panes 1 and 2.

During the colder periods of the year when the pane 1 has a lower temperature than the pane 32, a corresponding upwardly rising stream of air is created by means of a heating element 34 which may have the form of a radiator or an electrically heated element arranged beneath the insulating unit. Since the air rising in the space 33 has a higher temperature than the pane 1, said pane is warmed, and in turn, transfers heat to the chamber 10, thereby causing a reduction in contraction movements of the pane and, in addition, by controlling the supply of heat, enabling condensation between the glass panes to be totally avoided.

To prevent the dirtying of the mutually opposed surfaces of the panes 1 and 32, there is conveniently arranged a filter 35 in the inflow gap between the two panes. The pane 32 may also be arranged so that it can be dismantled or pivotted to enable the two surfaces to be cleaned when no filter is provided.

FIG. 6 shows in very simplified form an insulating unit having three glass panes 37, 38, 39. The glass pane 37 is stationarily arranged and is air-tight connected to a glass pane 38 by means of flexible elements of, for example, the type identified at 31 in FIG. 5, said glass pane 38 being pivotable around its bottom, substantially horizontal edge. The fixed glass pane 37 is connected to the glass pane 39 by means of sealing strips of the previously described type, for example by means of a strip 31 shown in FIG. 5, and the glass plate 39 is pivotable around its bottom, substantially horizontal edge in the previously described manner.

The aforedescribed embodiments may be modified without departing from the spirit of the invention. Thus, both of the glass panes 1 and 2 can be arranged for pivoting movement. Furthermore, the illustrated sealing means can be replaced with any suitable type of sealing means which permit the desired movement. With the described embodiments, the sealing means have been placed within the defining edges of the two glass panes and although this positioning of the sealing means is to be preferred it is possible to place the sealing means totally or partially outside said defining edges. The sealing means may be secured in any appropriate manner.

The inner surfaces of the sealing strips facing the sealed chamber are conveniently provided with light-reflecting elements or may be made light-reflecting by, for example, a mirror-like coating to ensure that the greatest possible amount of light is passed through the unit.

The automatic pressure equalization in the closed chamber of the insulating unit affords the important advantage whereby large volumes can be enclosed, as compared with conventional insulating units, thereby enabling the insulating properties of said unit to be increased to a corresponding degree.

What I claim as my invention and desire to secure by Letters Patent of the United States is:

1. In an insulating unit of the kind having at least two mutually opposing transparent plates joined together along their peripheral edge portions by means of a substantially gas-tight and liquid-light sealing means, said sealing means, together with said transparent plates, defining a closed, gas-tight and liquid-tight chamber and permitting movement between the plates, the improvement comprising means attached to at least one plate for allowing said one plate to pivot automatically with respect to said other plate around a fixed axis at its lower edge in response to changes in pressure in said closed chamber.

2. An insulating unit as claimed in claim 1, wherein additional means are provided to mount said other plate in a fixed position.

3. An insulating unit as claimed in claim 1, further comprising a third transparent plate arranged in a spaced relationship with one of said two plates which are pivotably movable relative to each other, said third transparent plate together with said one plate defining a space which is open at least at the bottom and top thereof to permit air to circulate therethrough.

4. An insulating unit as claimed in claim 3, further comprising an air heating element located in the bottom open end of said space.

5. An insulating unit as claimed in claim 1, wherein the bottom edge of said one plate engages at least one support body arranged to form a guide for said plate.

6. An insulating unit as claimed in claim 5, wherein said support body is stationarily arranged and is made of a flexible material.

7. An insulating unit as claimed in claim 3, wherein the third plane is stationarily mounted at a distance from a pivotable plate.

8. An insulating unit as claimed in claim 4, wherein the air-heating element is arranged between the plates.

* * * * *